US012564243B2

(12) United States Patent
Lucio et al.

(10) Patent No.: US 12,564,243 B2
(45) Date of Patent: Mar. 3, 2026

(54) GROOVE SYSTEM FOR FOOTWEAR OUTSOLES

(71) Applicant: ONCEPT LLC, New York, NY (US)

(72) Inventors: Manuel Nicole Lucio, New York, NY (US); Megan Key Campos, New York, NY (US)

(73) Assignee: ONCEPT LLC, New York, NY (US)

( * ) Notice: Subject to any disclaimer, the term of this patent is extended or adjusted under 35 U.S.C. 154(b) by 0 days.

(21) Appl. No.: 18/235,806

(22) Filed: Aug. 19, 2023

(65) Prior Publication Data

US 2025/0057285 A1 Feb. 20, 2025

(51) Int. Cl.
*A43B 13/14* (2006.01)

(52) U.S. Cl.
CPC ..... *A43B 13/141* (2013.01); *A43B 13/146* (2013.01)

(58) Field of Classification Search
None
See application file for complete search history.

(56) References Cited

U.S. PATENT DOCUMENTS 5,768,806 A * 6/1998 Parisotto ..... A43B 21/26 36/102
6,625,902 B2 * 9/2003 Yamamoto ..... A43B 13/14 36/102
7,225,564 B1 * 6/2007 Gillespie ..... A43B 3/30 36/35 R
7,281,343 B2 * 10/2007 Riha ..... A43B 13/141 D2/960
7,430,817 B2 * 10/2008 Abadjian ..... A43B 13/189 36/102
10,888,137 B2 * 1/2021 Izquieta Anaut .... A43B 7/1485
11,583,029 B2 * 2/2023 Lussier ..... A43B 13/16
2008/0148598 A1 * 6/2008 Schoenborn ..... A43B 7/144 36/28
2008/0229617 A1 * 9/2008 Johnson ..... A43B 3/0057 36/102
2013/0232821 A1 * 9/2013 Schindler ..... A43B 13/181 36/103
2016/0219974 A1 * 8/2016 Izquieta Anaut .... B29D 35/122

* cited by examiner

*Primary Examiner* — Jila M Mohandesi
(74) *Attorney, Agent, or Firm* — Bamert Regan PLLC

(57) ABSTRACT

Embodiments are directed toward footwear. The footwear includes an upper and an outsole that has a hindfoot region, a midfoot region, and a forefoot region. In some embodiments, the hindfoot region or the midfoot region has first raised portions that extend along the top side of the outsole in a first pattern. In some embodiments, the first raised portions are configured to provide the hindfoot region or the midfoot region with a first amount of vertical flexibility. In some embodiments, the forefoot region has second raised portions that extend along the top side of the outsole in a second pattern that is different than the first pattern. In some embodiments, the second raised portions are configured to provide the forefoot region with a second amount of vertical flexibility that is greater than the first amount of vertical flexibility.

19 Claims, 17 Drawing Sheets

GROOVE SYSTEM FOR FOOTWEAR OUTSOLES

FIELD OF THE INVENTION

The invention relates generally to footwear and, more particularly, to footwear outsoles.

BACKGROUND OF THE INVENTION

Footwear typically has an outside and an upper coupled to the outsole. The outsole separates the wearer's foot from the ground. It is therefore desirable for the outsole to have sufficient structural integrity to withstand the force of the wearer applied to the footwear and thus to the ground with each step. FIG. 1, for example, shows a top view of an outsole having crossing raised portions that define a honeycomb pattern. The honeycomb pattern provides structural support to the outsole. The honeycomb pattern, however, reduces the flexibility of the outsole. Accordingly, attempts have been made to improve the vertical flexibility of outsoles to facilitate more comfortable walking while providing sufficient structural integrity to the outsole.

FIG. 2 shows a bottom view of the outsole having the honeycomb pattern, and FIG. 3 shows a cross-sectional view of such outsole along line A-A' in FIG. 2. As shown in FIGS. 2 and 3, the underside of the outsole defines lateral grooves that are disposed along the longitudinal length of the outsole and that extend transverse to the central axis of the outsole. These grooves are configured to promote vertical flexibility of the outsoles. Such outsoles, however, remain stiff with respect to vertical flexibility.

For these reasons, there is a need for an outsole having improved flexibility while having structural strength. There is also a need for outsoles being lightweight. There is a further need for outsoles being durable.

SUMMARY OF THE INVENTION

It is therefore an object of the present invention to provide outsoles that provide increased flexibility that promotes a natural gate cycle.

It is also an object of the present invention to provide outsoles that achieve the above object and that also provide structural strength to maintain stability throughout the outsole and especially the hindfoot and arch regions while preventing excessive torsion in the forefoot region.

It is another object of the present invention to provide outsoles that achieve the above objects and that also provide varying flexibility along the longitudinal length of the outsole.

It is a further object of the present invention to provide outsoles that achieve the above objects and that also have a reduced weight.

It is yet another object of the present invention to provide outsoles that achieve the above objects and that have maintained or improved durability.

The invention achieves the above objects, as well as other objects and advantages that will become apparent from the description that follows, by providing an outsole. The outsole has a hindfoot region, a midfoot region, and forefoot region disposed opposite the midfoot region from the hindfoot region. The outsole has a top side and an underside that is configured to contact the ground while the wearer walks. In some embodiments, the invention achieves the above objects, as well as other objects and advantages that will become apparent from the description that follows, by providing footwear that includes the outsole and an upper coupled to the outsole.

In some embodiments, the hindfoot region or the midfoot region has first raised portions that extend along the top side of the outsole in a first pattern. In some embodiments, the first raised portions are configured to provide the hindfoot region or the midfoot region with a first amount of vertical flexibility. In some embodiments, the forefoot region has second raised portions that extend along the top side of the outsole in a second pattern. In some embodiments, the second pattern is different than the first pattern. In some embodiments, the second raised portions are configured to provide the forefoot region with a greater amount of vertical flexibility than the hindfoot region or the midfoot region. In some embodiments, the first raised portions and the one or more second raised portions are configured to increase the structural strength of the outsole. Accordingly, the second raised portions increase the flexibility of the outsole while maintaining or improving its structural strength.

In some embodiments, the first raised portions and the second raised portions are configured to increase the structural strength of the outsole compared to another outsole that is the same except that it lacks the first raised portions or the second raised portions.

In some embodiments, the first raised portions include raised crossing portions that intersect each other. In some embodiments, the second raised portions include raised non-crossing portions that do not intersect each other. In some embodiments, each of the one or more second raised portions defines a sinusoidal wave shape.

In some embodiments, the upper includes a third raised portion on the top side. In some embodiments, the third raised portion defines a boundary between the first pattern and the second pattern. In some embodiments, the third raised portion intersects each of the first raised portions that extend to the boundary. In some embodiments, the third raised portion intersects each of the first raised portions that extend to the boundary at a location where two or more of such first raised portions meet each other. In some embodiments, the third raised portion does not intersect the second raised portions.

In some embodiments, the upper includes a raised perimeter portion that extends along a perimeter of the outsole. In some embodiments, the raised perimeter portion surrounds the first raised portions or the second raised portions. In some embodiments, the raised perimeter portion defines a notch between two or more adjacent second raised portions. In some embodiments, the notch is configured to increase flexibility of the outsole.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

An article of footwear in accordance with the principles of the invention is generally indicated at reference number 2 in the Figures of the attached drawings, wherein numbered elements in the Figures correspond to like numbered elements herein.

Figure 1:
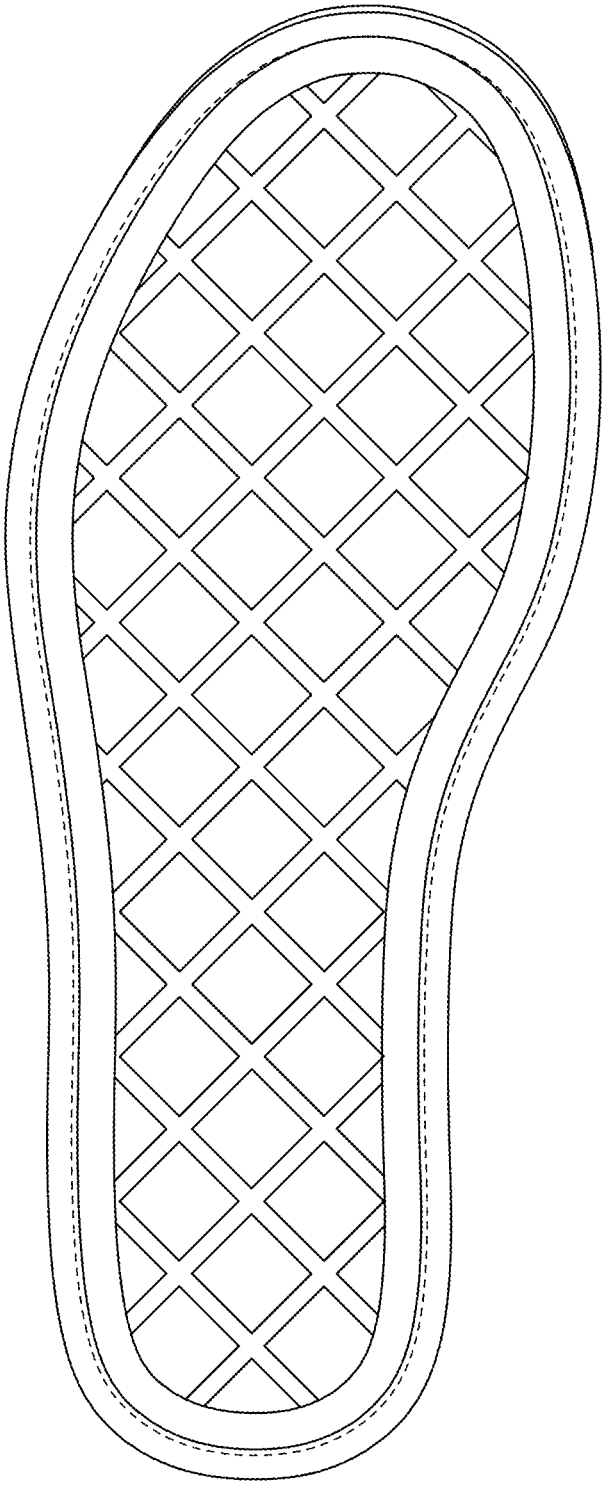
FIG. 1 (Prior Art)
FIG. 1 is a top plan view of an outsole.
Figure 2:
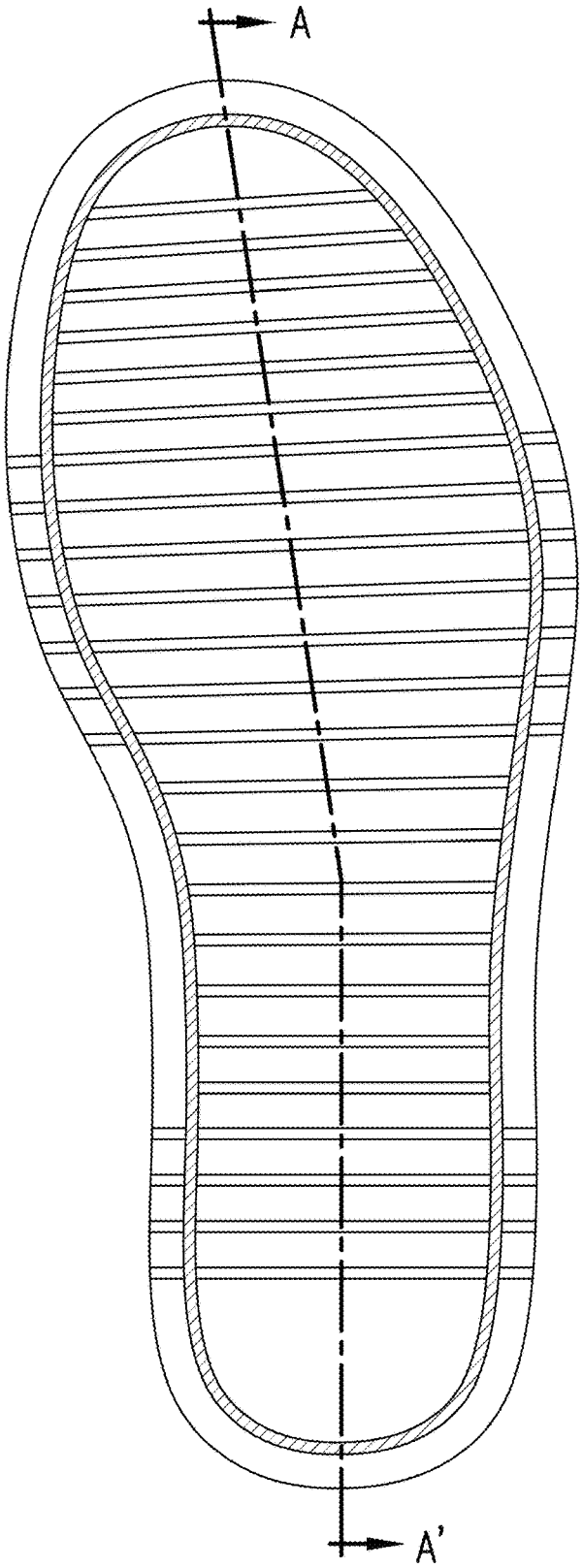
FIG.2 (Prior Art)
FIG. 2 is a bottom plan view of the outsole of FIG. 1.
Figure 3:
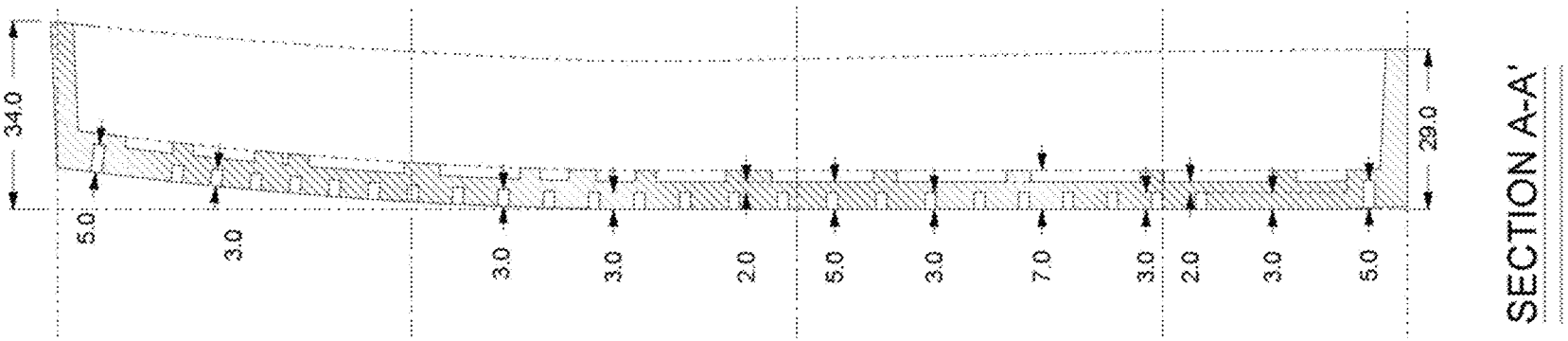
Fig. 3 (Prior Art)
FIG. 3 is a cross-sectional view of the outsole of FIG. 1, taken along the line A-A' in FIG. 2.
Figure 4:
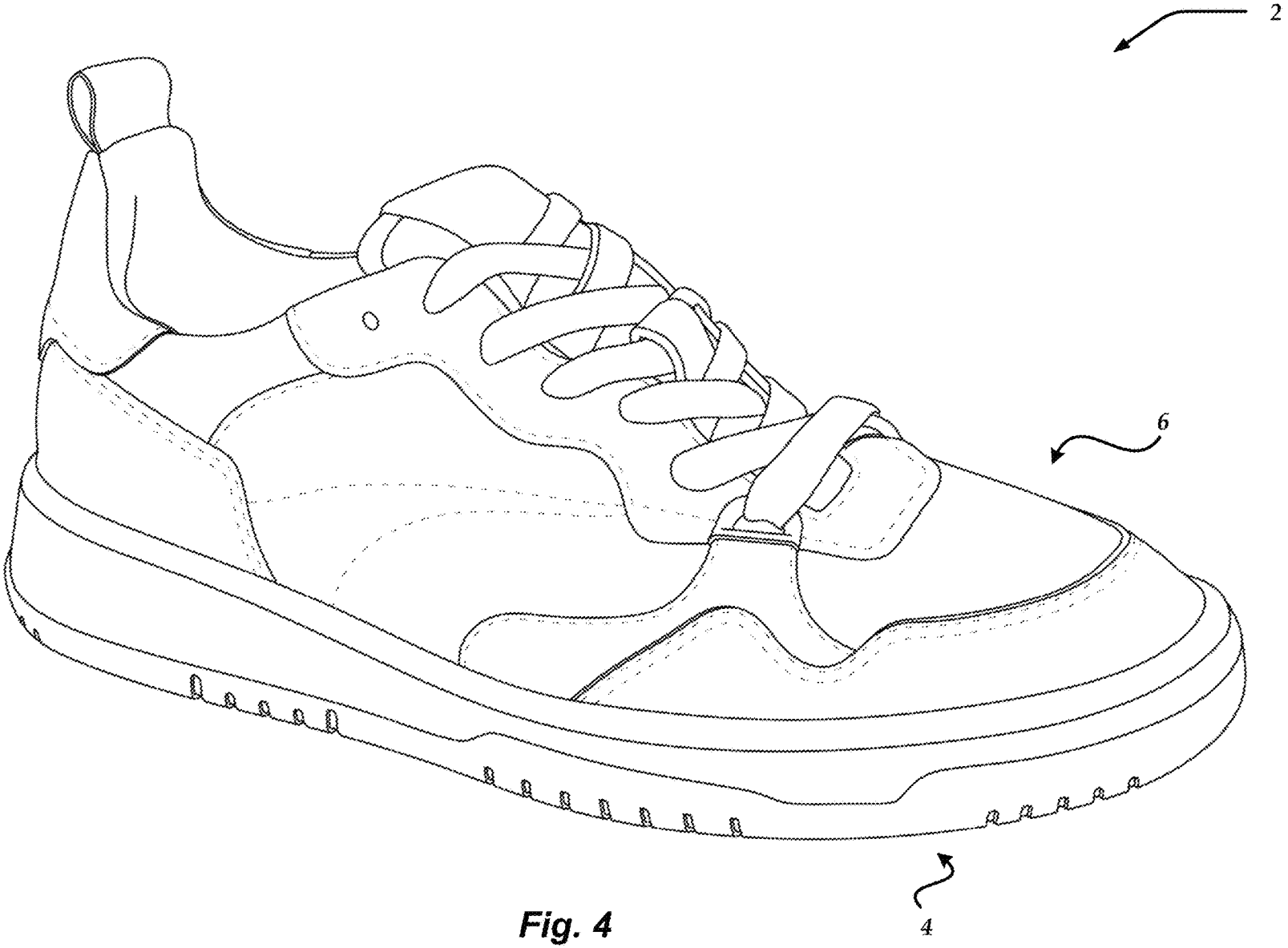
FIG. 4 is a perspective view of an article of footwear having an outsole according to a first embodiment of the invention.
Figure 5:
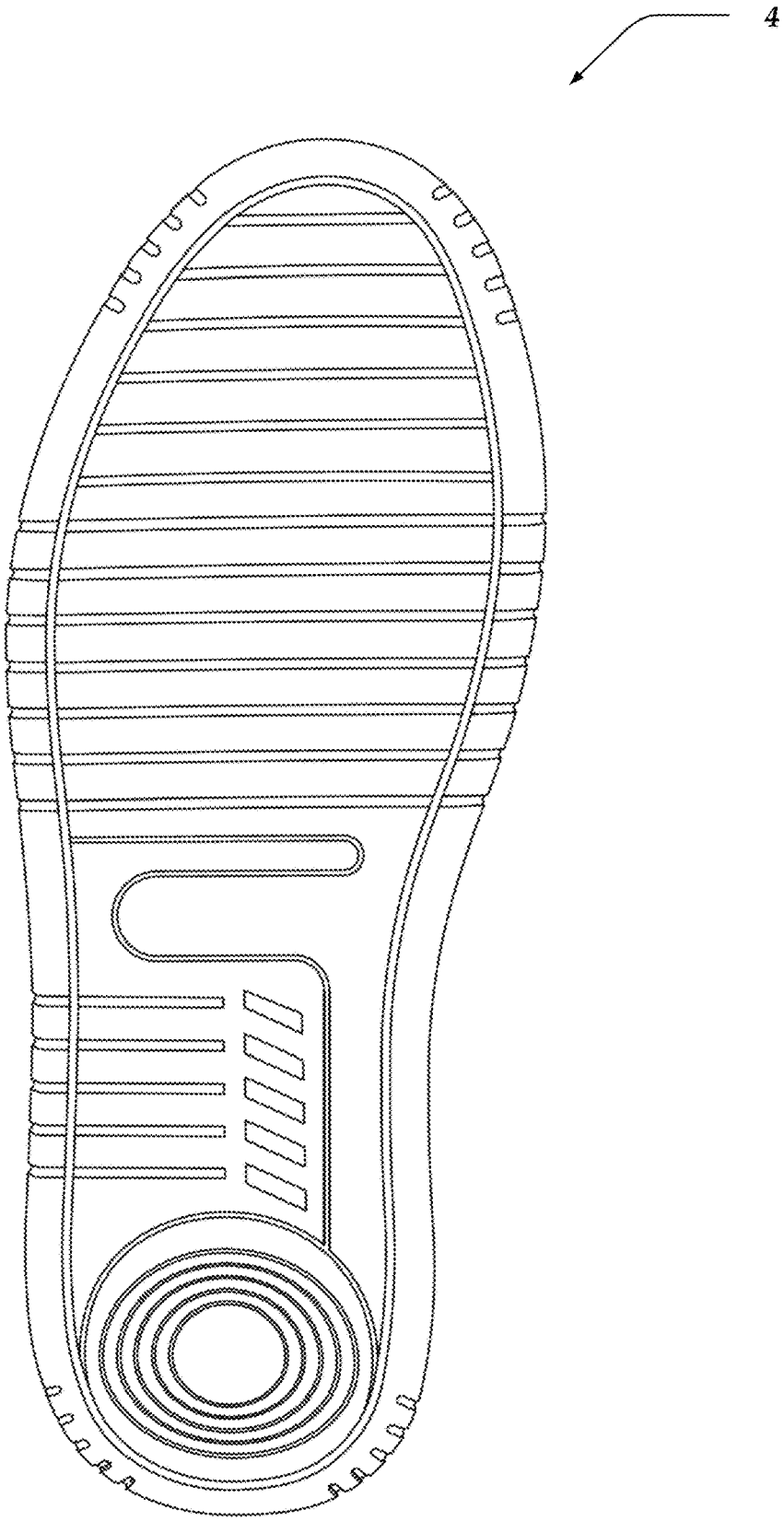
FIG. 5 is a bottom plan view of the outsole of FIG. 4.
Figure 6:
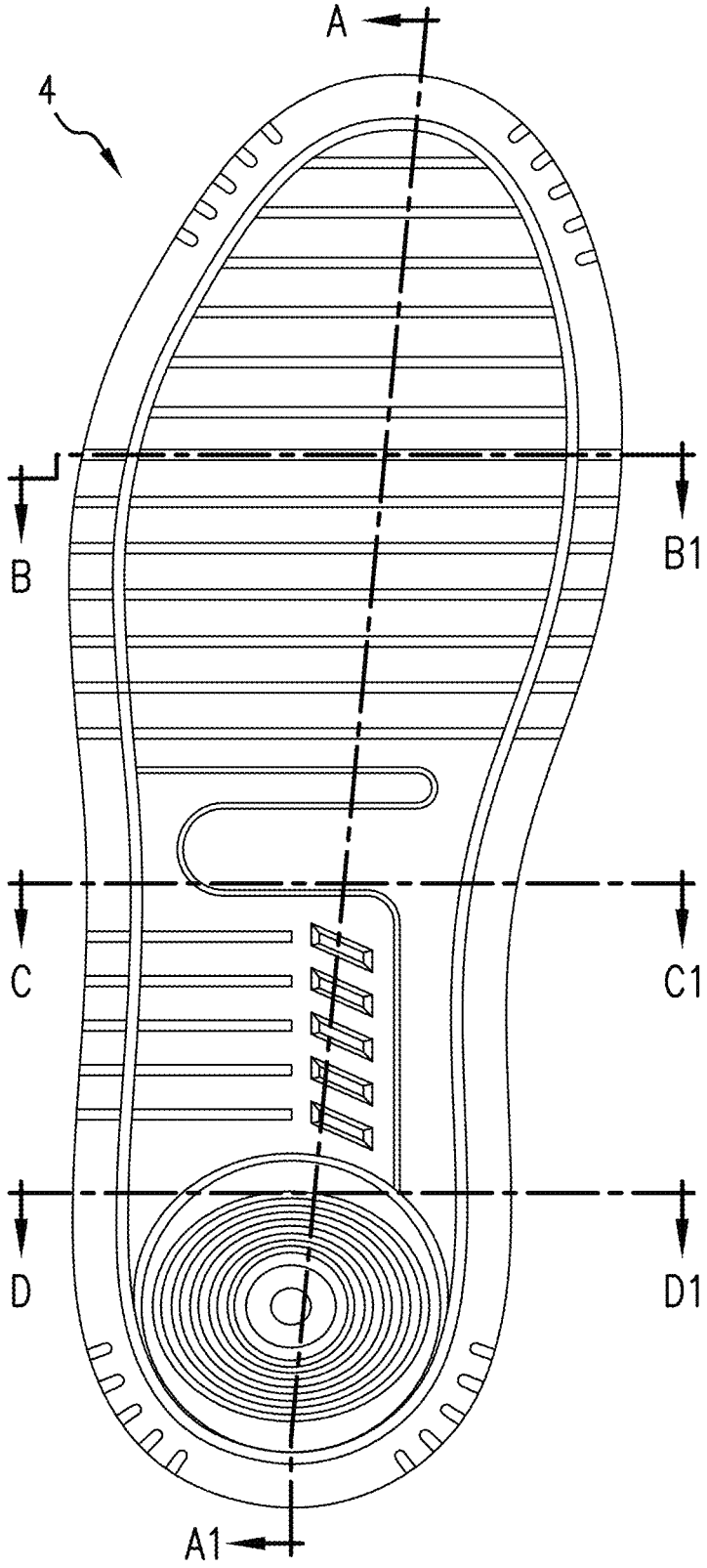
FIG. 6 is an isometric bottom plan view of the outsole of FIG. 4.
Figure 7:
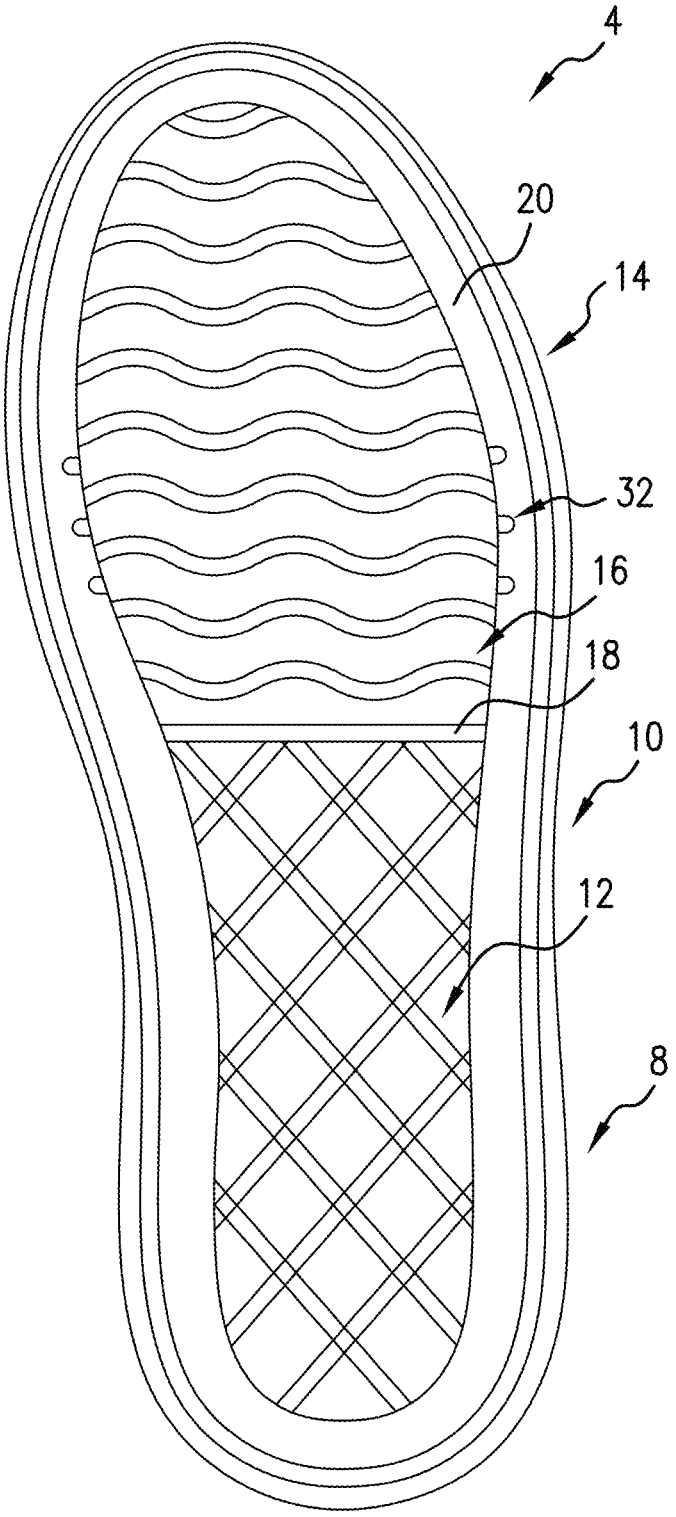
FIG. 7 is an isometric top plan view of the outsole of FIG. 4.
Figure 8:
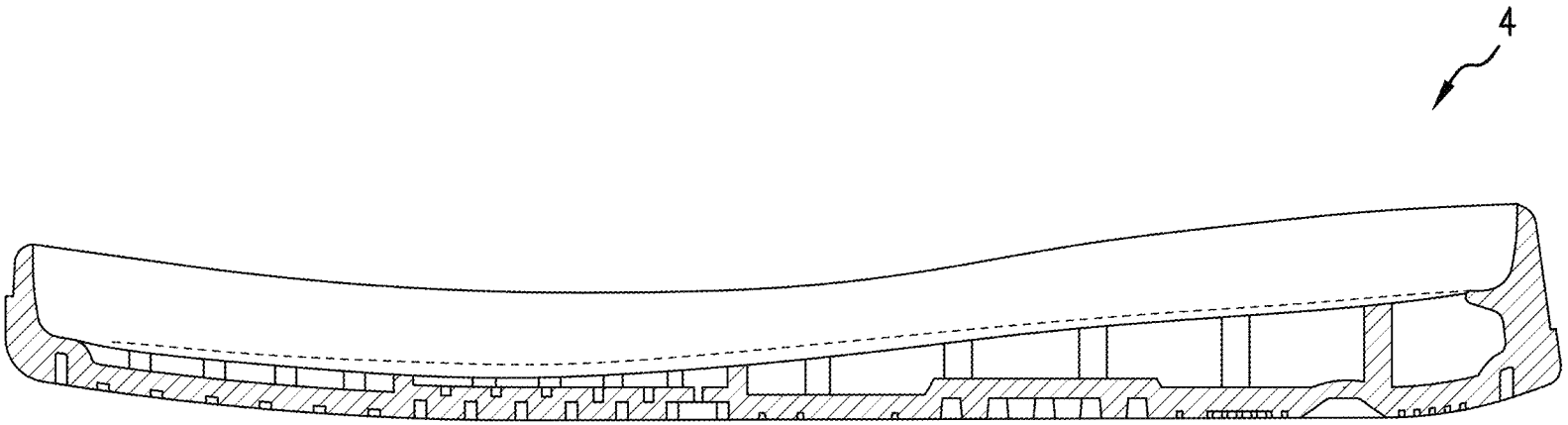
FIG. 8 is an isometric cross-sectional view of the outsole of FIG. 4, taken along the line A-A1 in FIG. 6.
Figure 9:
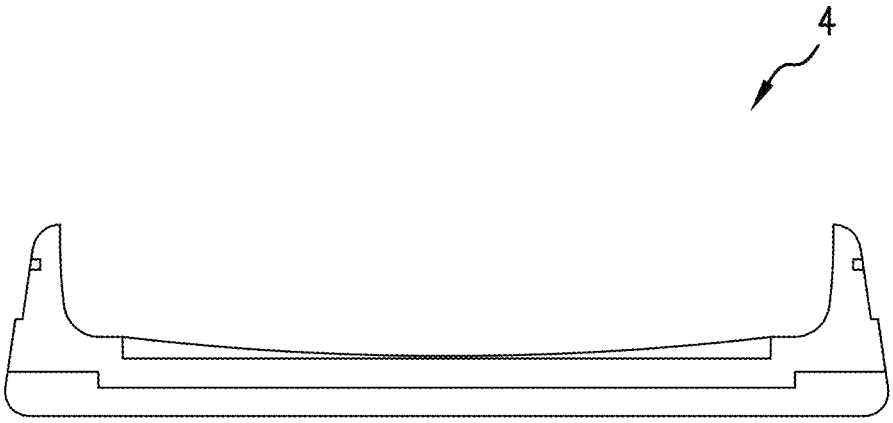
FIG. 9 is an isometric cross-sectional view of the outsole of FIG. 4, taken along the line B-B1 in FIG. 6.
Figure 10:
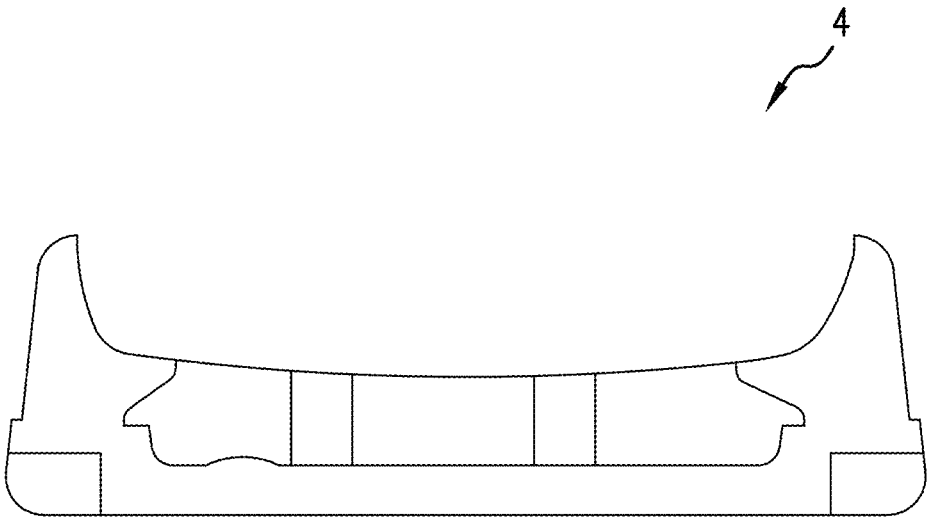
FIG. 10 is an isometric cross-sectional view of the outsole of FIG. 4, taken along the line C-C1 in FIG. 6.
Figure 11:
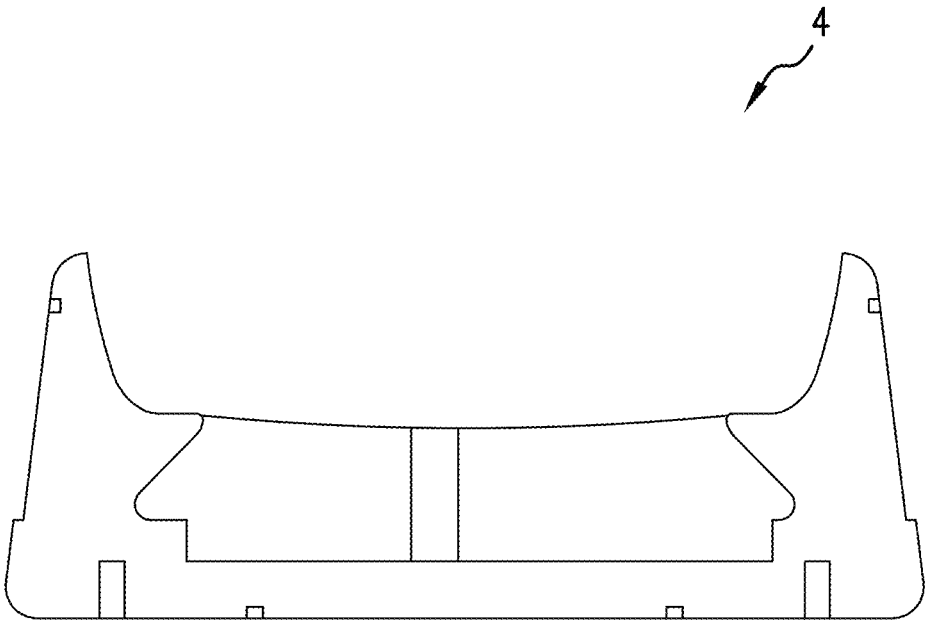
FIG. 11 is an isometric cross-sectional view of the outsole of FIG. 4, taken along the line D-D1 in FIG. 6.
Figure 12:
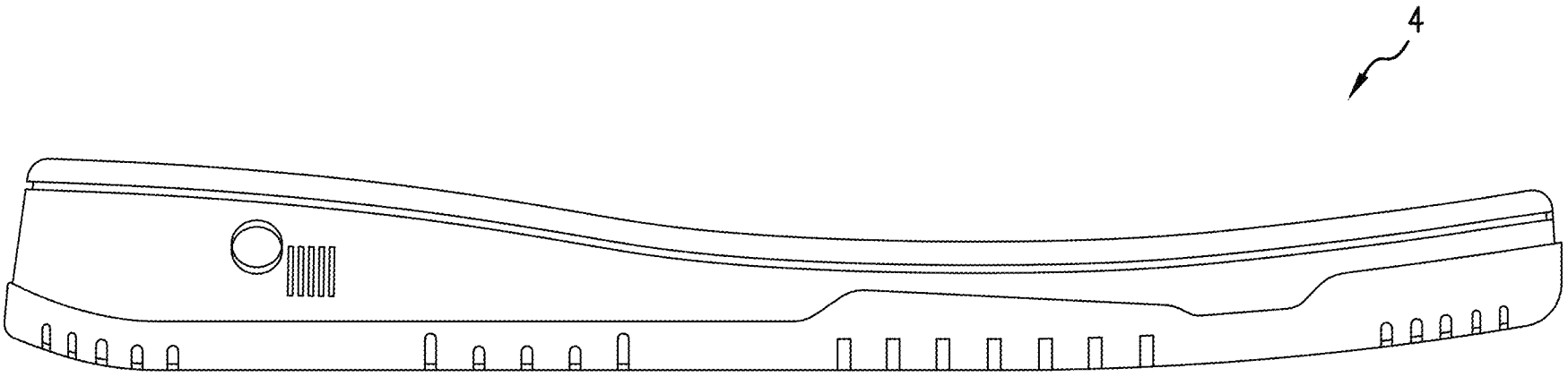
FIG. 12 is an isometric lateral side view of the outsole of FIG. 4.
Figure 13:
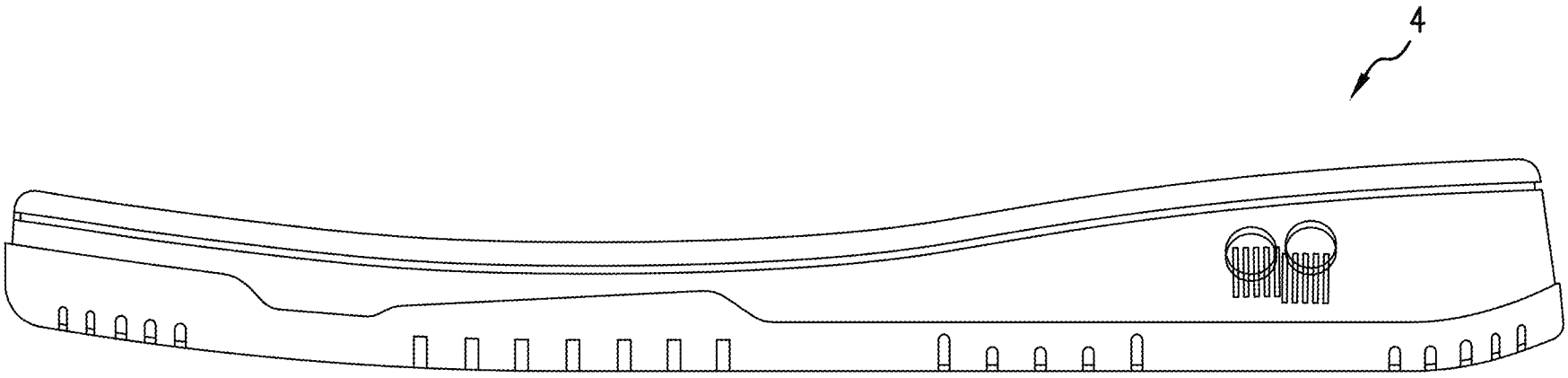
FIG. 13 is an isometric medial side view of the outsole of FIG. 4.

As shown in FIG. 1, the footwear 2 has an outsole 4 and an upper 6 coupled to the outsole 4. In some embodiments, the upper 6 is glued to the outsole 4. As shown in FIGS. 5 and 6, the underside of the outsole 4 has multiple grooves that extend across the longitudinal axis of the outsole 4 to promote vertical flexibility of the outsole 4 in the regions of such grooves. As shown in FIG. 7, however, the hindfoot region 8 and the midfoot region 10 of the top side of the outsole 4 have crossing raised portions 12 that define a honeycomb pattern while the forefoot region 14 of the top side of the outsole 4 has non-crossing raised portions 16 that define a different pattern than the pattern in the hindfoot region 8 or the midfoot region 10, according to some embodiments. Accordingly, the forefoot region 12 of the outsole 4 has increased vertical flexibility compared to the hindfoot region 8 or the midfoot region 10.

In some embodiments, one or more of the non-crossing raised portions 16 define a nonlinear shape or path. As shown in FIG. 7, for example, one or more of the non-crossing raised portions 16 define a wave shape or path, such as a sinusoidal wave. Such shape or path increases the structural strength of the outsole in the area of such nonlinear non-crossing raised portion 16 compared to a linear non-crossing raised portion. As shown in FIG. 7, the transition between the crossing raised portions 12 and the non-crossing raised portions 16 is defined by, in some embodiments, raised portion 18 that defines a boundary between the region having the pattern that is different than the hindfoot region 8 or the midfoot region 10. In some embodiments, the boundary portion 18 intersects each raised portion 12 that extends to such boundary at the crossing of such crossing raised portions 12 (i.e., the boundary portion 18 intersects two or more raised portions 12 at a given intersection along the boundary), as shown in FIG. 7. Accordingly, the boundary portion 18 facilitates increasing the structural strength of the outsole 4 along such boundary compared to a boundary portion that intersects each raised portion 12 that extends to such boundary at a point that is offset from the crossing of such crossing raised portions (i.e., such alternative boundary portion intersects a single raised portion 12 at given intersection along the boundary).

In some embodiments, the top side of the outsole 4 has a raised perimeter portion 20 that surrounds the raised portions 12, 16, or 18. In some embodiments, as shown in FIG. 7, the raised perimeter portion 20 defines notches 32 between two or more adjacent non-crossing raised portions 16 or a non-crossing raised portion 16 and the raised boundary portion 18. The notches 32 further promote vertical flexibility of the outsole 4 in the forefoot region.

As shown in the cross-sectional views of FIGS. 8-11, the non-crossing raised portions 16 are separated from each other by recesses defined by the top side of the outsole 4. As also shown in the cross-sectional views of FIGS. 8-11, the crossing raised portions 12 are also separated from each other by recesses defined by the top side of the outsole 4, except in the locations where such raised portions 12 cross each other.

Figure 14:
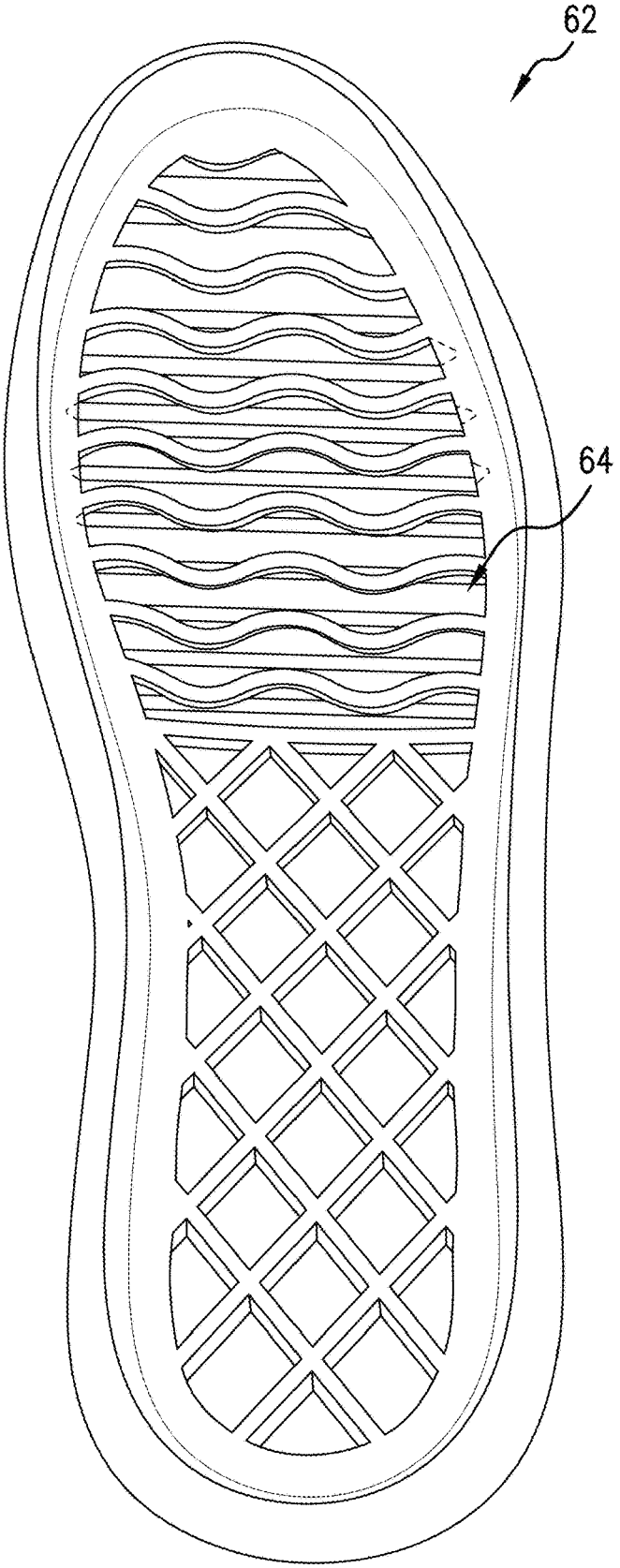
FIG. 14 is a top plan view of a second embodiment of an outsole according to the principles of the invention.
Figure 15:
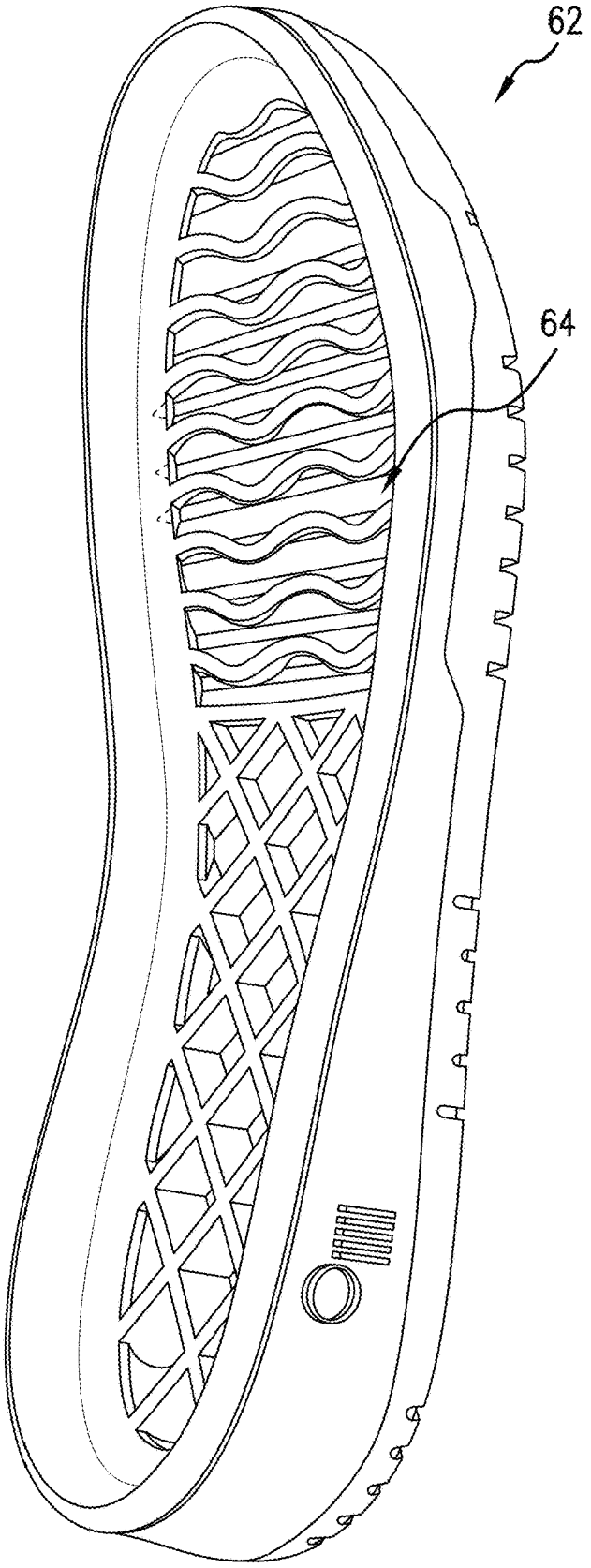
FIG. 15 is a top perspective view of the outsole of FIG. 14.

In some embodiments, such as the embodiment of the outsole 62 shown in FIGS. 14 and 15, the underside of the outsole 62 defines one or more grooves while the top side of the outsole 62 has one or more humps 64 directly over and extending along such one or more grooves that facilitate providing an increased amount of material disposed directly over such grooves without increasing the thickness of the entire recess between two or more non-crossing raised portions or a non-crossing raised portion and the boundary raised portion. Accordingly, such humps 64 facilitate further promoting vertical flexibility of the outsole 62, as well as facilitating a reduced weight of the outsole 62. In FIGS. 14 and 15, markings are shown on the perimeter portion that corresponds to the perimeter portion 20 of FIG. 7 to highlight the lack of notches in the embodiment shown in FIGS. 14 and 15. As highlighted by the humps 64 in FIG. 15, the non-crossing raised portions are, in some embodiments, spaced farther apart from each other along the longitudinal axis of the outsole 62 than the grooves in the same region of the outsole 62. Accordingly, in some embodiments, the humps 64 are positioned differently than each other with respect to the respectively adjacent non-crossing raised portion that is forward or rearward of the humps 64.

Figure 16:
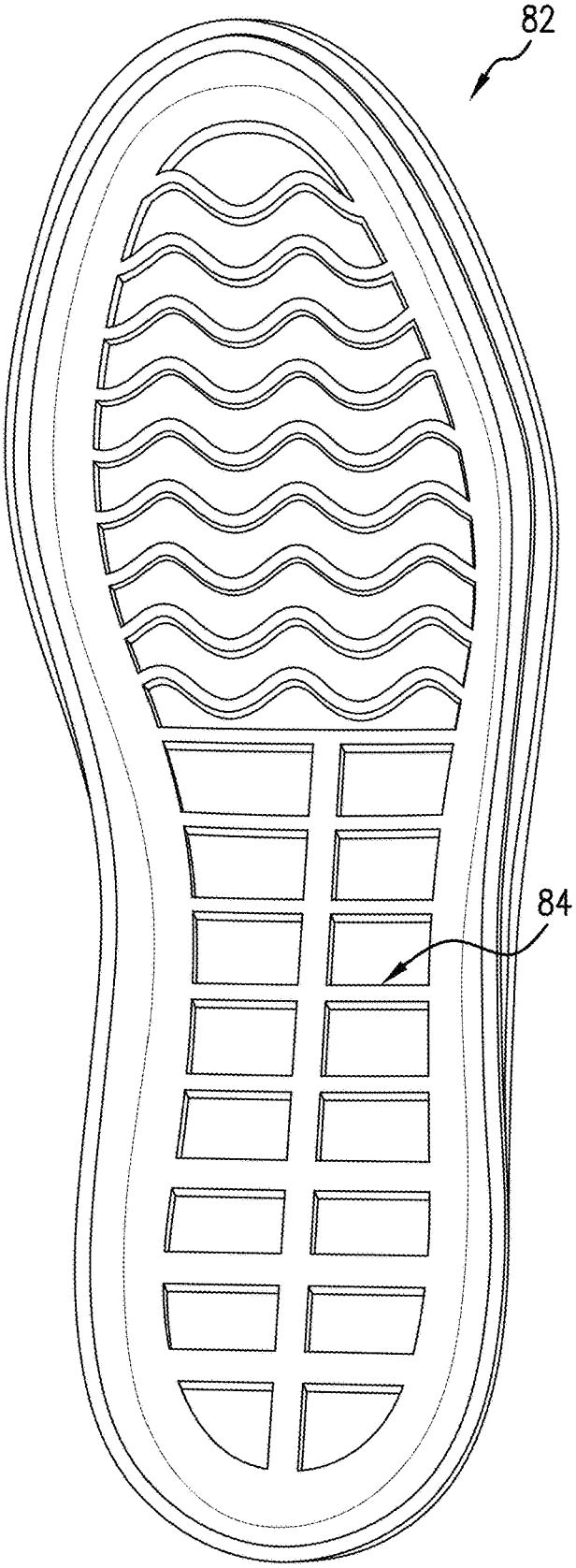
FIG. 16 is a top plan view of a third embodiment of an outsole according to the principles of the invention.
Figure 17:
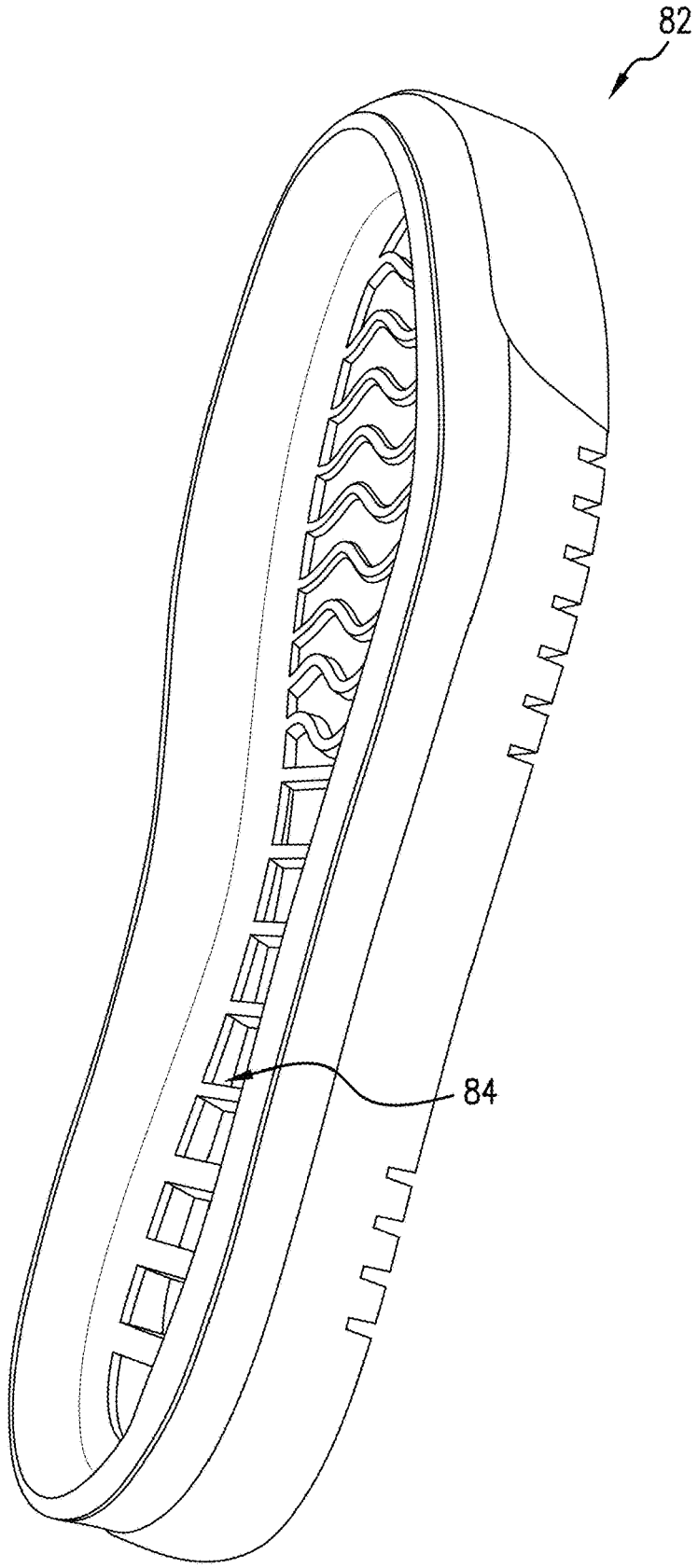
FIG. 17 is a top plan view of the outsole of FIG. 16.

In some embodiments, such as the embodiment of the outsole 82 shown in FIGS. 16 and 17, the raised portions such as the crossing raised portions 84 have different shapes or define different patterns or paths than those shown with respect to the embodiments of the outsole 4 or the outsole 62.

The embodiments of the outsole 4, the outsole 62, and the outsole 82 are substantially the same other than the differences explained above. Those differences may be combined with other features, characteristics, or elements of other embodiments of outsoles described or shown herein.

In some embodiments, the outsole has a layer of material disposed over the top side of the outsole such as over the raised portions, such as the raised perimeter, the raised non-crossing portions, the raised crossing portions, or the raised boundary portion.

The dimensions shown in FIGS. 6-12 are in millimeters, unless the context clearly shows otherwise. In some embodiments, the outsoles are injection molded unitary structures.

As used herein, the following terms take the meanings explicitly associated herein, unless the context clearly dictates otherwise. The terms "front," "forward," "rear," and "rearward" are defined relative to central or longitudinal axis of the outsole. The terms "front" and "forward" indicate the portion of the footwear that is opposite the midfoot region from the hindfoot region. The terms "rear" and "rearward" indicate the portion of the footwear that is opposite the midfoot region from the forefoot region. The terms "height," "vertical," "upper," "lower," "above," "below," "top," "bottom," "topmost," and "bottom-most" are defined relative to vertical axis of outsole while the underside of the outsole rests on horizontal ground. The vertical axis is non-parallel to the longitudinal axis and is defined as parallel to the direction of the earth's gravity force on the footwear when the underside of the outsole is on horizontal ground. The term "lateral" is defined relative to the lateral axis of the outsole. The lateral axis is non-parallel to the longitudinal and vertical axes. The longitudinal axis extends through the middle of the outsole through the hindfoot, midfoot, and forefoot regions along the length of the outsole.

The term "configured" as used herein means an element being one or more of sized, dimensioned, positioned, or oriented to achieve or provide the recited function or result. The term "directly coupled" as used herein means that a component contacts (for example, when glued) or is welded to another component. The term "indirectly coupled" as used herein means that a first component is coupled to a second component by way of one or more intervening components that are directly coupled to the first and second components. A first component that is indirectly coupled to a second component is directly coupled to a third component, which may be directly coupled to the second component or to a fourth component that is directly coupled to the second component. The term "coupled" should therefore be understood to disclose both direct and indirect coupling of components or elements that are described as being coupled to each other.

The term "substantially parallel" refers to parallel or within 5, 10, 15, 20, 25, 30, 35, 40, or 45 degrees of parallel. The term "substantially orthogonal" refers to orthogonal or within 5, 10, 15, 20, 25, 30, 35, 40, or 45 degrees of orthogonal. The term "substantially horizontal" or "substantially horizontally" refers to horizontal or within 5, 10, 15, 20, 25, 30, 35, 40, or 45 degrees of horizontal. The term "substantially vertical" or "substantially vertically" refers to vertical or within 5, 10, 15, 20, 25, 30, 35, 40, or 45 degrees of vertical. The term "approximately" or "substantially" refers to within 1, 5, 10, 15, 20, 25, 30, 40, or 50 percent of the identified value or range.

The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular.

While the preferred embodiment of the invention has been illustrated and described, as noted above, many changes can be made without departing from the spirit and scope of the invention. Each disclosure of a component preferably having a feature or characteristic is intended to also disclose the component as being devoid of that feature or characteristic, unless the principles of the invention clearly dictate otherwise. Accordingly, the scope of the invention is not limited by the disclosure of the preferred embodiment. Instead, the invention should be determined entirely by reference to the claims that follow. It should also be noted that the claim dependencies or combinations of elements recited in the claims do not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (such as "The apparatus or method of any one of the preceding or subsequent claims . . . "). This disclosure is also intended to disclose the subject matter of any one of the dependent claims, as if it was an independent claim, with or without all or a portion of the subject matter of the original independent claim(s) or any other subject matter disclosed herein.

Those of ordinary skill in the art will conceive of other alternate embodiments of the invention upon reviewing this disclosure. Thus, the invention is not to be limited to the above description but is to be determined in scope by the claims that follow.

The invention claimed is:

1. A footwear comprising:

an upper; and an outsole coupled to the upper, the outsole having a hindfoot region, a midfoot region, and a forefoot region disposed opposite the midfoot region from the hindfoot region, the outsole having a top side and an underside that is configured to contact the ground while a wearer of the footwear walks, one or more of the hindfoot region or the midfoot region having one or more first raised portions that extend along the top side of the outsole in a first pattern, the one or more first raised portions being configured to provide the one or more of the hindfoot region or the midfoot region with a first amount of vertical flexibility, the forefoot region having one or more second raised portions that extend along the top side of the outsole in a second pattern that is different than the first pattern, the one or more second raised portions being configured to provide the forefoot region with a second amount of vertical flexibility that is greater than the first amount of vertical flexibility, the one or more first raised portions and the one or more second raised portions being configured to increase the structural strength of the outsole, wherein the underside of the outsole defines grooves that extend across a longitudinal axis of the outsole, each of the one or more second raised portions being disposed over at least a portion of a respective one of the grooves and being misaligned with at least another portion of the respective one of the grooves; and a raised perimeter portion that extends along a perimeter of the outsole and that surrounds the one or more first raised portions and the one or more second raised portions, wherein the raised perimeter portion defines a notch between two adjacent ones of the one or more second raised portions, whereby the notch increases flexibility of the outsole, whereby the one or more second raised portions increase the flexibility of the outsole.

2. The footwear of claim 1, wherein the one or more first raised portions and the one or more second raised portions are configured to increase the structural strength of the outsole compared to another outsole that has each characteristic, element, and configuration of the outsole except lacks the one or more first raised portions and the one or more second raised portions.

3. The footwear of claim 1, wherein the one or more first raised portions include raised crossing portions that intersect each other.

4. The footwear of claim 1, wherein the one or more second raised portions include raised non-crossing portions that do not intersect each other.

5. The footwear of claim 4, wherein the one or more first raised portions include raised crossing portions that intersect each other.

6. The footwear of claim 5, wherein each of the one or more second raised portions defines a sinusoidal wave shape.

7. The footwear of claim 5, further comprising a third raised portion on the top side of the outsole, the third raised portion defining a boundary between a region of the top side that has the first pattern and a region of the top side that has the second pattern, the third raised portion intersecting each of the one or more first raised portions that extend to the boundary.

8. The footwear of claim 7, wherein the third raised portion intersects each of the one or more first raised portions that extend to the boundary at a location where two or more of the one or more first raised portions that extend to the boundary meet each other.

9. The footwear of claim 7, wherein the third raised portion does not intersect the one or more second raised portions.

10. The footwear of claim 1, wherein the notch has an opening that opens into a space defined by and between the two adjacent ones of the one or more second raised portions, and the notch has a perimeter that extends outward from the raised perimeter portion.

11. A footwear outsole comprising:

a hindfoot region;

a midfoot region; and a forefoot region disposed opposite the midfoot region from the hindfoot region, the outsole having a top side and an underside that is configured to contact the ground while a wearer of footwear having the outsole walks, one or more of the hindfoot region or the midfoot region having one or more first raised portions that extend along the top side of the outsole in a first pattern, the one or more first raised portions being configured to provide the one or more of the hindfoot region or the midfoot region with a first amount of vertical flexibility, the forefoot region having one or more second raised portions that extend along the top side of the outsole in a second pattern that is different than the first pattern, the one or more second raised portions being configured to provide the forefoot region with a second amount of vertical flexibility that is different than the first amount of vertical flexibility, the one or more first raised portions and the one or more second raised portions being configured to increase the structural strength of the outsole, wherein the underside of the outsole defines grooves that extend across a longitudinal axis of the outsole, each of the one or more second raised portions being disposed over at least a portion of a respective one of the grooves and being misaligned with at least another portion of the respective one of the grooves; and a raised perimeter portion that extends along a perimeter of the outsole and that surrounds the one or more first raised portions and the one or more second raised portions, wherein the raised perimeter portion defines a notch between two adjacent ones of the one or more second raised portions, whereby the notch increases flexibility of the outsole.

12. The footwear of claim 11, wherein the one or more first raised portions include raised crossing portions that intersect each other.

13. The footwear of claim 11, wherein the one or more second raised portions include raised non-crossing portions that do not intersect each other, the second amount of vertical flexibility being greater than the first amount of vertical flexibility.

14. The footwear of claim 13, wherein the one or more first raised portions include raised crossing portions that intersect each other.

15. The footwear of claim 14, wherein each of the one or more second raised portions defines a sinusoidal wave shape.

16. The footwear of claim 14, further comprising a third raised portion on the top side of the outsole, the third raised portion defining a boundary between a region of the top side that has the first pattern and a region of the top side that has the second pattern, the third raised portion intersecting each of the one or more first raised portions that extend to the boundary.

17. The footwear of claim 16, wherein the third raised portion intersects each of the one or more first raised portions that extend to the boundary at a location where two or more of the one or more first raised portions that extend to the boundary meet each other.

18. The footwear of claim 16, wherein the third raised portion does not intersect the one or more second raised portions.

19. The footwear of claim 11, wherein the notch has an opening that opens into a space defined by and between the two adjacent ones of the one or more second raised portions, and the notch has a perimeter that extends outward from the raised perimeter portion.

* * * * *